US007509697B2

(12) United States Patent
Dorenbeck

(10) Patent No.: US 7,509,697 B2
(45) Date of Patent: Mar. 31, 2009

(54) HEIGHT-ADJUSTABLE BED

(75) Inventor: Günther Dorenbeck, Wetter (DE)

(73) Assignee: Völker AG, Witten (DE)

( * ) Notice: Subject to any disclaimer, the term of this patent is extended or adjusted under 35 U.S.C. 154(b) by 150 days.

(21) Appl. No.: 11/703,533

(22) Filed: Feb. 7, 2007

(65) Prior Publication Data

US 2007/0234477 A1 Oct. 11, 2007

(30) Foreign Application Priority Data

Feb. 11, 2006 (DE) ..... 10 2006 006 320

(51) Int. Cl.
*A61G 7/012* (2006.01)

(52) U.S. Cl. ..... 5/611

(58) Field of Classification Search ..... 5/611, 5/600, 607–610, 616
See application file for complete search history.

(56) References Cited

U.S. PATENT DOCUMENTS 6,920,656 B2 * 7/2005 Roussy ..... 5/611
2005/0283911 A1 * 12/2005 Roussy ..... 5/611
2007/0083992 A1 * 4/2007 Lindner et al. ..... 5/611
2007/0083993 A1 * 4/2007 Lindner ..... 5/611

FOREIGN PATENT DOCUMENTS

DE 43 20 092 A1 12/1993
DE 44 06 784 C1 8/1995
DE 1999 15 431 A1 10/2000

* cited by examiner

*Primary Examiner*—Alexander Grosz
(74) *Attorney, Agent, or Firm*—Shumaker & Sieffert, P.A.

(57) ABSTRACT

A bed, in particular a sickbed or nursing bed, comprises a height-adjustable bedstead having a frame comprising frame side parts and frame transverse parts and, in the region of the frame transverse parts, legs connected with each other in pairs by means of cross bracings. The legs have lower ends supported on a floor and, at their opposite upper ends, are supported and slidably guided at guiding profiles extending in parallel to the frame side parts. Further, the bed comprises two lifting assemblies each having a drive unit comprising a housing, and a pushrod adapted to be moved out of the housing and into the housing by the drive unit. The two lifting assemblies are arranged in the region of the frame side parts, leaving a space for accommodation of an adjustment drive for an adjustable mattress supporting device.

4 Claims, 5 Drawing Sheets

HEIGHT-ADJUSTABLE BED

RELATED FOREIGN APPLICATION

The present application claims the priority of German Patent Application No. 10 2006 006 320.1, filed Feb. 11, 2006, the entire disclosure of which is incorporated herein by reference.

BACKGROUND OF THE INVENTION

1. Field of the Invention

The invention relates to a bed which is in particular a sickbed or a nursing bed.

2. Description of Related Art

Sickbeds or nursing beds are normally height-adjustable for making it easier for nursing staff to nurse a patient or a test person. Such beds normally comprise side parts on both sides of a lying surface, said side parts being adapted to prevent the patient from falling out of the bed.

It is known that, depending on their mental or physical condition, the patients try to climb over the side parts in order to leave the bed. In doing so, the patients may fall when climbing over the side parts, which entails a considerable risk of injury.

Thus it is desirable that a sickbed or nursing bed can be lowered to such an extent that the upper edges of the side parts are located at a height where there is only a small risk of injury for a patient climbing over the side bars. Ideally, the bed can be lowered to such an extent that its lying surface is located only a few centimeters (20 to 30 cm, for example) above a floor. At such a low position, a side protection can even be omitted since there is hardly any risk of injury if a patient "falls" out of the bed from a height of only a few centimeters.

It is common practice to realize height-adjustable bedsteads of sickbeds or nursing beds either by telescoping or length-adjustable vertical legs or by so-called scissor-type mechanisms. The scissor-type mechanisms offer the advantage that the beds can be lowered to an extremely low level. Examples of scissor-type mechanisms for height-adjustable bedsteads are shown in DE 43 20 092 A1, DE 44 06 784 C1 and DE 199 15 431 A1.

The known height-adjustable beds having a scissor-type mechanism or scissor levers comprise a frame having frame side and frame transverse parts, wherein pivotable legs are arranged at the head end and the foot end of the frame. The legs comprise lower ends supported on the floor, while their opposite ends are slidably guided along the frame. The legs are adapted to be pivoted via a centrally arranged drive mechanism such that the bedstead is lifted or lowered.

For further increasing the comfort, sickbeds or nursing beds comprise adjustable lying surfaces, i.e. adjustable mattress supporting devices. These devices comprise individually adjustable or pivotable portions which are adapted to be adjusted by a motor. An adjustment drive is located below the lying surface or the mattress supporting surface of the mattress supporting device. The height-adjustable bedstead of the sickbed or nursing bed may not collide with this adjustment drive, which means that the bed can be lowered only to a position in which the lying surface is located at such a height above the floor that a side protection cannot be omitted. In other words, the adjustment drive thus prevents sickbeds or nursing beds equipped with a scissor-type mechanism or a similar height adjustment means from being lowered down to a location as near to the floor as possible.

SUMMARY OF THE INVENTION

It is thus an object of the invention to provide a bed, in particular a sickbed or nursing bed, which can be lowered to as large an extent as possible, and wherein an adjustment drive arranged below a lying surface for adjusting the lying surface has no adverse effect on the capability of lowering the bed down to a position in which a side protection is not required.

For achieving this object, the invention proposes a bed, in particular a sickbed or nursing bed, which comprises

- a height-adjustable bedstead having a frame comprising frame side and frame transverse parts and, in the region of the frame transverse parts, legs connected with each other in pairs by means of cross bracings, wherein the legs have lower ends supported on a floor and, at their opposite upper ends, are supported and slidably guided at guiding profiles extending in parallel to the frame side parts, and
- two lifting assemblies each having a drive unit comprising a housing, and a pushrod adapted to be moved out of the housing and into the housing by the drive unit,
- wherein each lifting assembly extends between one of the frame transverse parts on the one hand, and the cross bracing arranged between the pair of legs opposite said frame transverse part on the other hand, and, at its housing as well as at the free end of its push rod facing away from said housing, is connected with the respective frame transverse part or the cross bracing, and,
- wherein the two lifting assemblies are arranged in the region of the frame side parts, leaving a space between the two lifting assemblies for accommodation of an adjustment drive for an adjustable mattress supporting device.

According to the invention, the height-adjustable lower bedstead portion comprises two lifting devices arranged at both sides of the longitudinal axis (axis in longitudinal direction between a head and a foot end of the bed) instead of a centrally disposed lifting assembly. Between the two lifting assemblies there is a free space into which the adjustment drive provided for a mattress supporting device and arranged below said mattress supporting device is inserted when the bed is in its lowermost position. According to the invention, the adjustment drive for the mattress supporting device thus does not collide with the drive for pivoting the legs for the purpose of height adjustment of the bed.

According to the invention, each lifting assembly comprises a drive unit having a housing, and a push rod movable out of the housing and into the housing. The lifting devices are located between one of the transverse frame parts of the frame of the bedstead and the cross bracings of one of the pairs of legs. In this manner, each pair of legs is engaged by one lifting assembly. In those regions where the lifting assemblies are connected with the cross bracings of the legs, the respective leg is slidably supported at the guiding profile. The guiding profiles also extend near the frame side parts. The other leg, which has no lifting assembly connected therewith, does not necessarily require a guiding structure since it is rigidly connected via the cross bracing with the leg of the respective pair of legs which is guided along the guiding profile.

However, for reasons of stability, the invention provides for that leg of the pair of legs, which is not (directly) engaged by a lifting assembly, to be supported at the guiding profile and thus to be guided there in longitudinal direction. This special feature is associated with the use of two lifting assemblies which are spaced apart to the largest extent possible thus leaving a space between the lifting assemblies such that any tilting movements performed by the frame with respect to the adjustable legs are prevented according to the invention. The two lifting assemblies comprise a distance to each other in longitudinal extension of the frame, and an offset to the central longitudinal axis of the frame, in which offset portion they are arranged on both sides of the central longitudinal axis.

In a preferred embodiment of the invention, each cross bracing comprises a cross brace and two angular or arcuate braces which extend from the cross brace to the upper ends of the legs, and, at said angular or arcuate braces, the legs are guided and supported at the guide profiles.

Further, it is appropriate when the legs are articulated to support braces which are supported at the frame in a manner rotatable about axes extending in parallel to the frame transverse parts.

BRIEF DESCRIPTION OF THE DRAWINGS

An embodiment of the invention will now be described in greater detail with reference to the drawings in which.

DETAILED DESCRIPTION OF THE PREFERRED EMBODIMENT OF THE INVENTION

Figure 2:
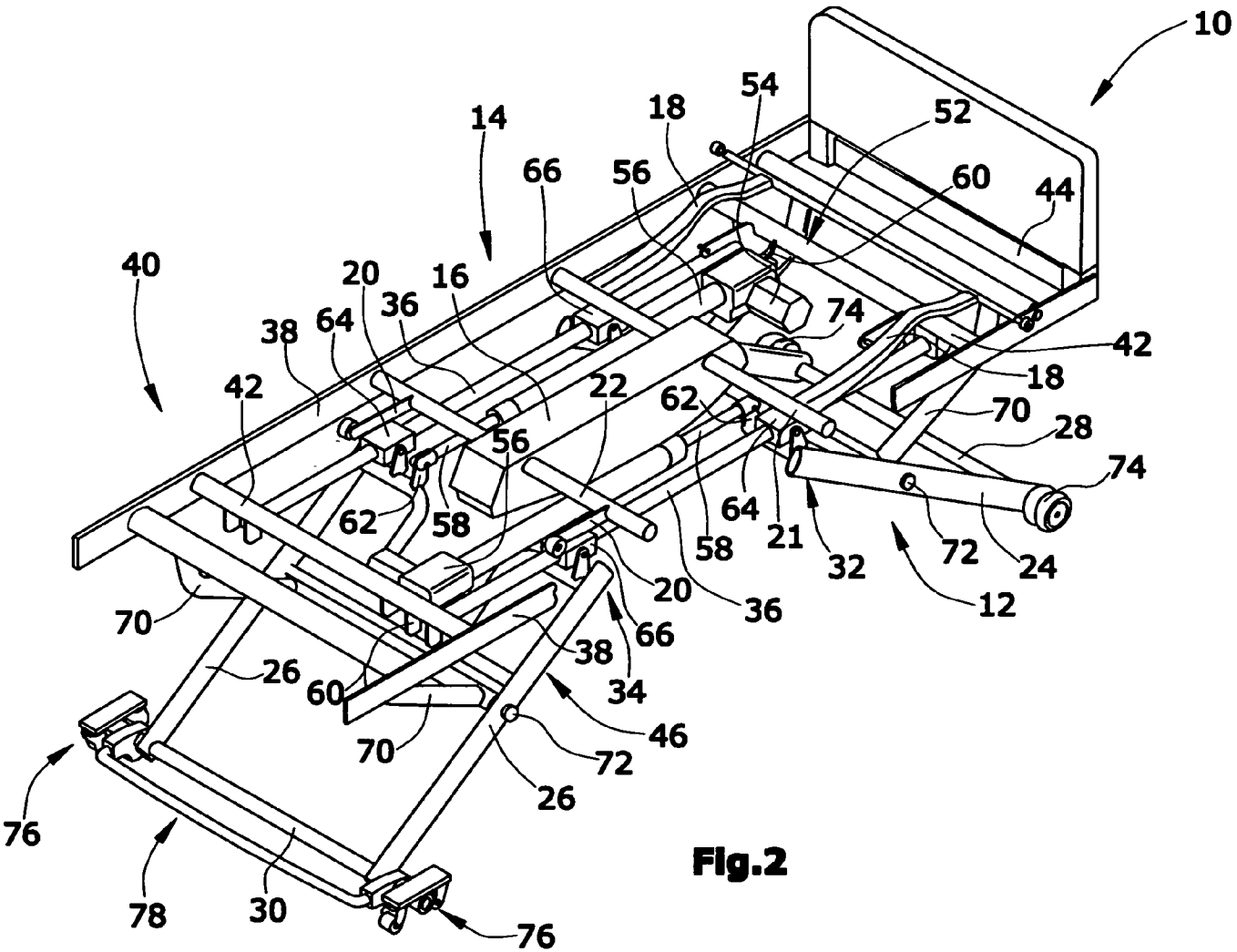
FIG. 2 shows a perspective view of a height-adjustable lower bedstead portion (with depicted head end of the bed) in a mid-height position.
Figure 3:
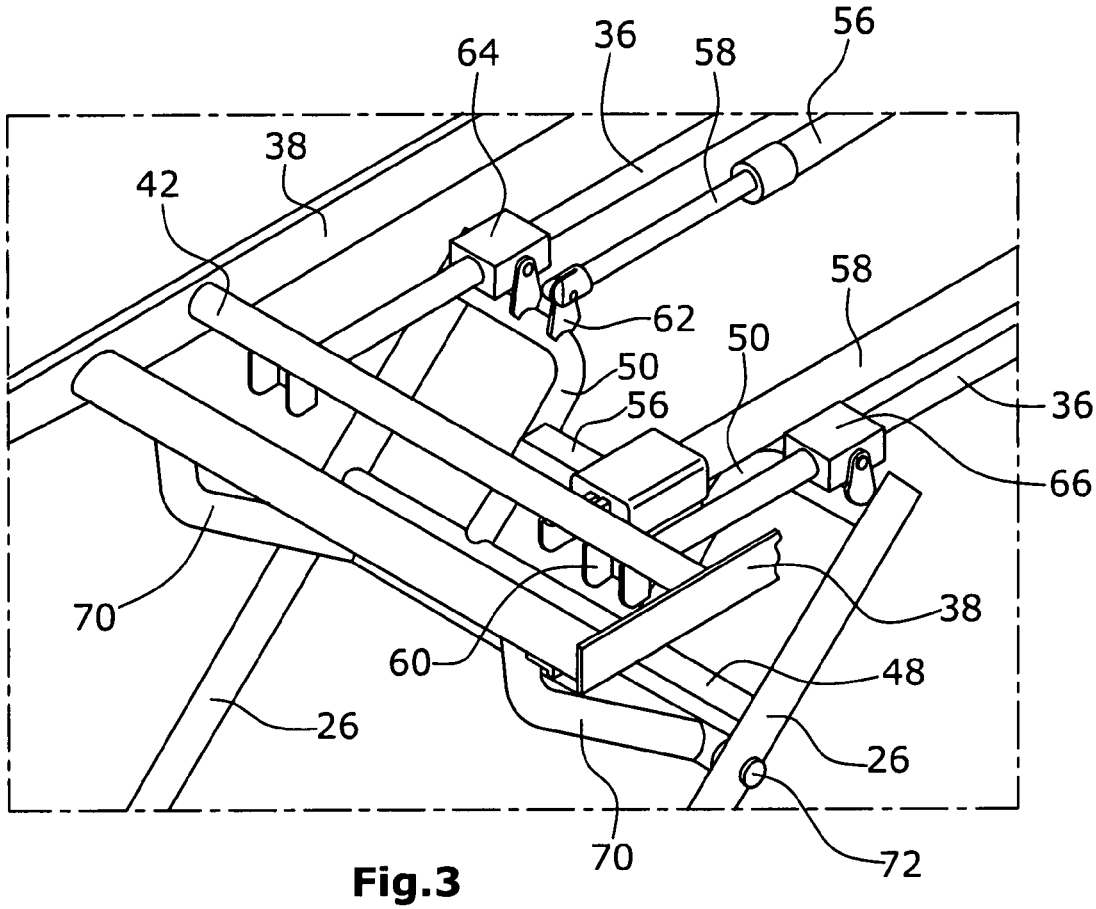
FIG. 3 shows a detail of FIG. 2 on a larger scale.
Figure 4:
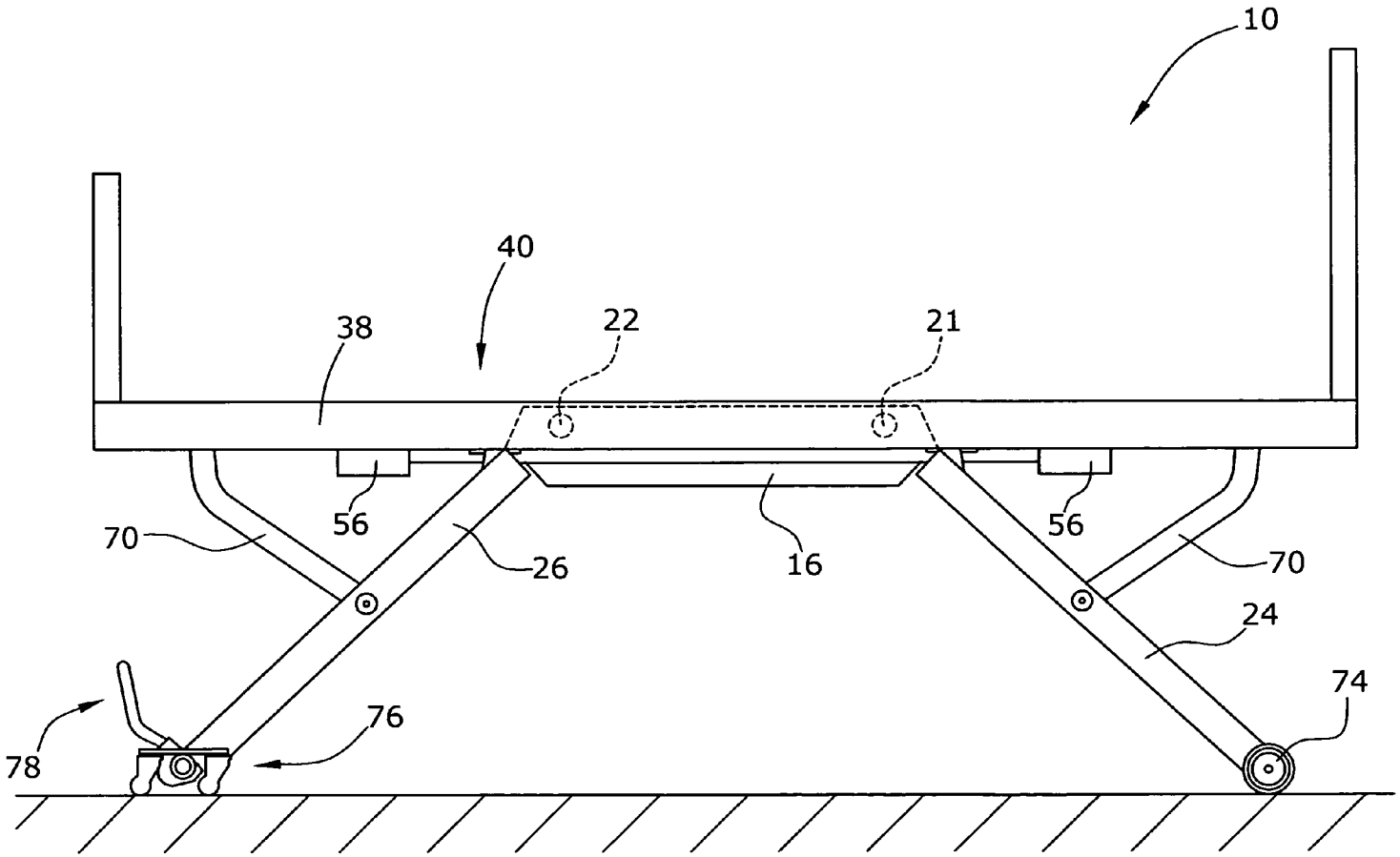
FIG. 4 shows a side view of the height-adjustable bed.

As shown in the Figures, the bed 10 comprises a height-adjustable lower bedstead portion 12 upon which rests a mattress supporting device 14 and/or to which said device is fastened. FIG. 2 merely shows the adjustment drive 16 and the adjustable levers 18 and 20 as well as the driven rotating axes 21, 22 of the mattress supporting device 14 associated therewith. The individual mattress support portions are not shown in the Figures for the sake of clarity. The bedstead 12 comprises a head end-side pair of legs 24 and a foot end-side pair of legs 26 with the respective legs of a pair being rigidly connected with each other at their lower ends by a cross bracing 28, 30. The upper ends 32, 34 of the legs 24, 26 are guided along guiding profiles 36. These guiding profiles 36 extend horizontally and in parallel to side frame parts 38 of a frame 40 which also comprises transverse frame parts 42, 44. The guiding profiles 36 extend between the transverse frame parts 42 to which they are fastened.

Figure 1:
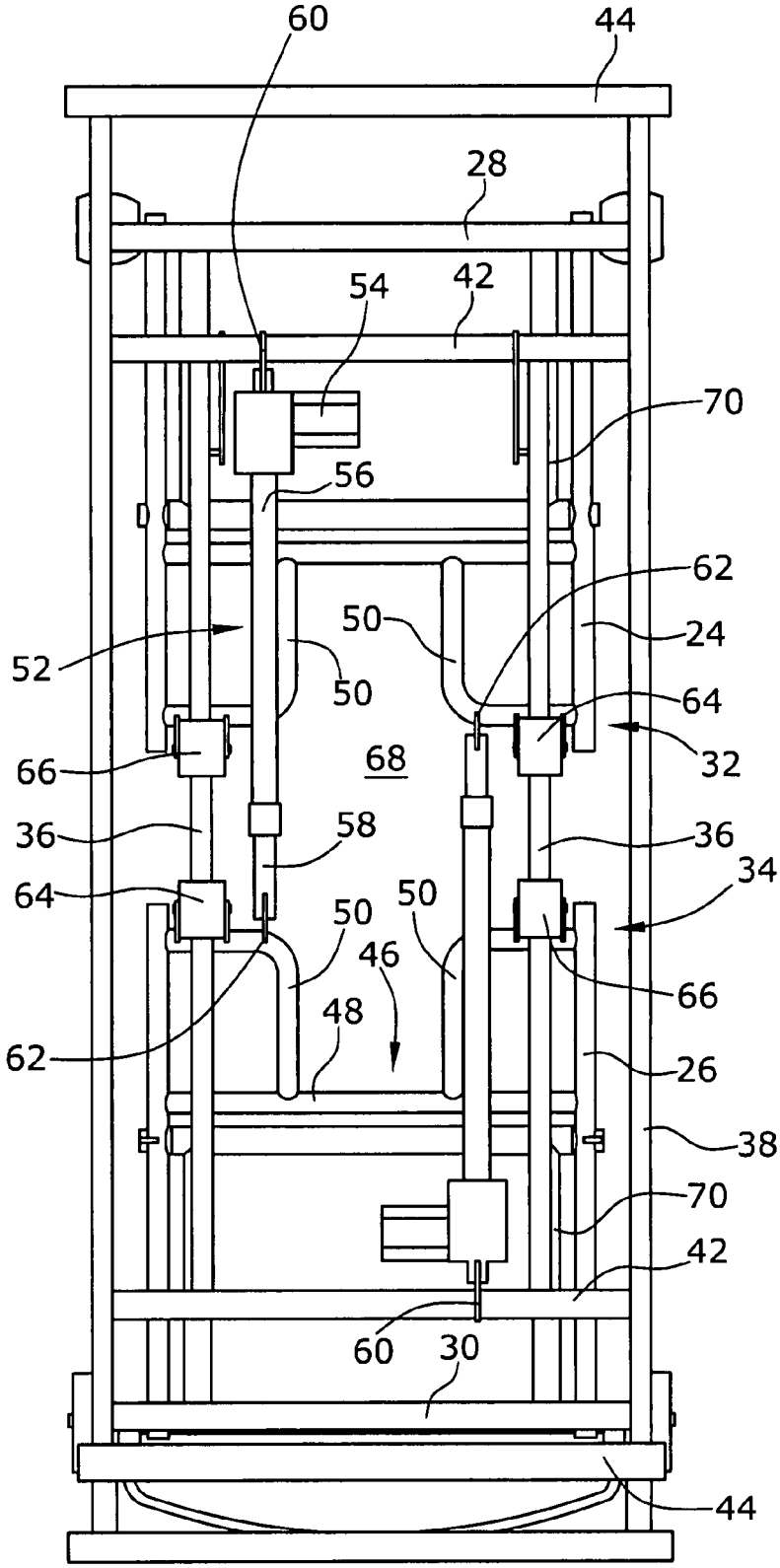
FIG. 1 shows a top view of a bedstead of a sickbed or a nursing bed in the completely lowered position.

The legs 24, 26 of each pair are connected with each other via a cross bracing 46. Said cross bracing 46 comprises a cross brace 48 and two angular or arcuate braces 50 which extend from the cross brace 48, i.e., each angular or arcuate brace 50 extends up to the upper end 32 and 34, respectively, of one of the legs 24 and 26, respectively. This is shown in FIG. 1.

Between the transverse frame parts 42 and the angular or arcuate braces 50 two lifting assemblies 52 are located, each comprising a drive unit 54 having a housing 56 and a push rod 58. By means of the drive unit 54 the push rod 58 can be optionally moved out of the housing 56 or into the housing. The housing 56 of each lifting assembly 52 is fastened to a transverse frame part 42 (depicted at 60 in the Figures), while the push rod 58 is attached to the bracing 46 or the angular or arcuate brace 50 of the bracing 46 (at 62 in the Figures) arranged opposite the transverse frame part 42 at which the housing 56 of said lifting assembly 52 is supported. In the region of the connections 60 of the push rods 58 with the angular or arcuate braces 50, i.e., in the region of the connection of the angular or arcuate braces 50 with the upper ends 32, 34 of the legs 24 and 26, the legs are guided via slide blocks 64 along the guide profiles 36. Said slide blocks 64 are fastened to the angular or arcuate braces 50.

Even those angular or arcuate braces 50, which are not engaged by push rods 58, are guided via slide blocks 66 along the guiding profiles 36.

Figure 5:
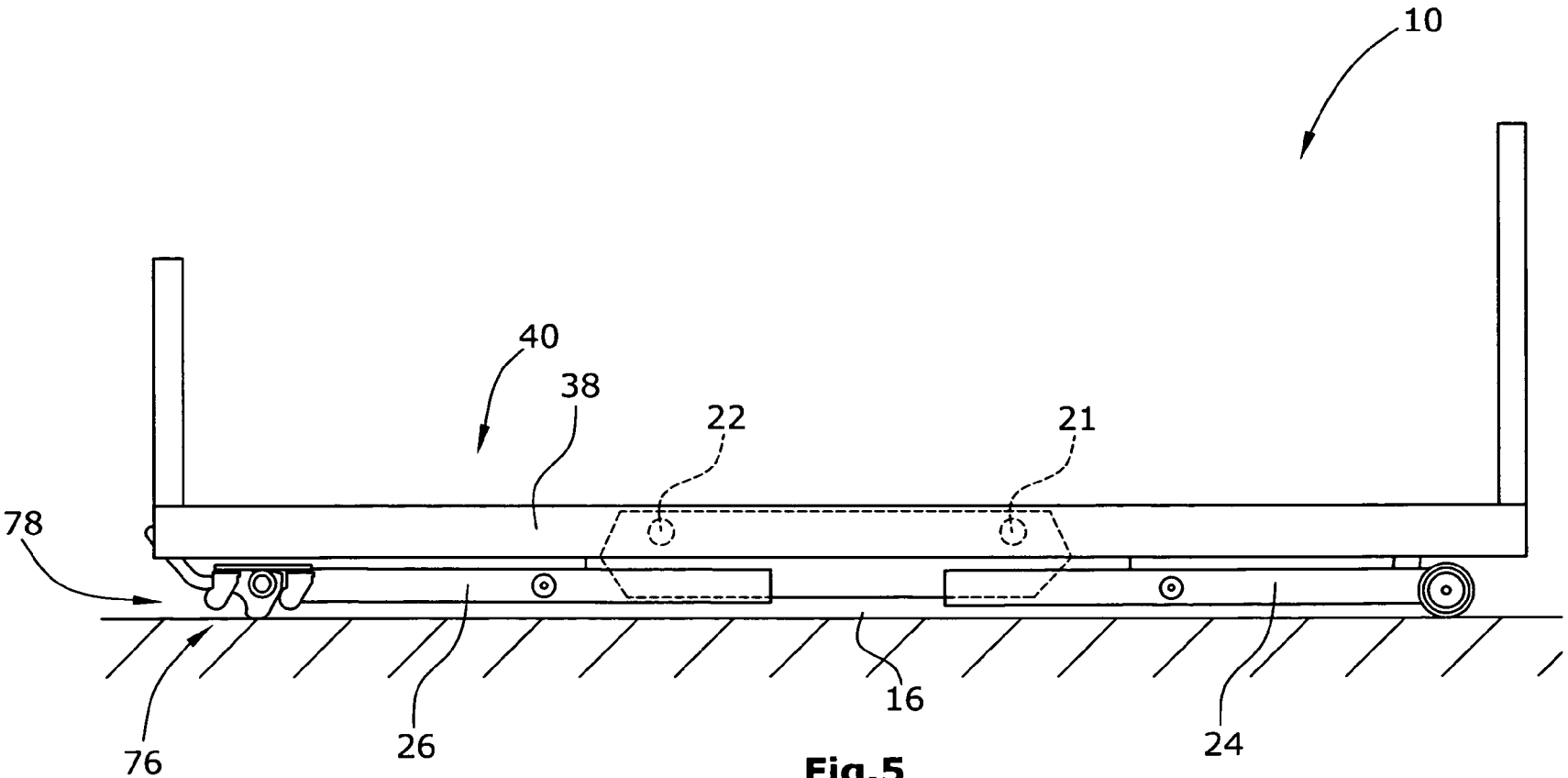
FIG. 5 shows a side view of the height-adjustable bed in the lowermost height-adjusting position.

Division of a centrally arranged drive for height adjustment of the bed into two eccentrically arranged lifting assemblies 52 according to the invention allows a free space 68 to be created in the central region of the bedstead 12. The free space serves for accommodation of the adjustment drive 16 for the mattress supporting device 14. This allows the bed to be lowered down to an extremely low position, as shown in FIG. 5.

Finally, the legs 24 and 26 are supported via support braces 70 at the frame 40. The support braces 70 are pivotably connected with the legs 24, 26 (depicted at 72). The legs 24, 26 comprise castors 74 or castor assemblies 76. Further, a fixing brake 78 is provided.

Although the invention has been described and illustrated with reference to a specific illustrative embodiment thereof, it is not intended that the invention be limited to this illustrative embodiment. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A bed, in particular a sickbed or nursing bed, comprising:

a height-adjustable bedstead having a frame comprising frame side parts and frame transverse parts and, in the region of the frame transverse parts, legs connected with each other in pairs by means of cross bracings, wherein the legs have lower ends supported on a floor and, at their opposite upper ends, are supported and slidably guided at guiding profiles extending in parallel to the frame side parts, and two lifting assemblies each having a drive unit comprising a housing, and a pushrod adapted to be moved out of the housing and into the housing by the drive unit, wherein each lifting assembly extends between one of the frame transverse parts and the cross bracing arranged between the pair of legs opposite the frame transverse part, and wherein at the housing as well as at a free end of the push rod facing away from the housing, each lifting assembly is connected with the respective frame transverse part or the cross bracing, and, wherein the two lifting assemblies are arranged in the region of the frame side parts, leaving a space between the two lifting assemblies for accommodation of an adjustment drive for an adjustable mattress supporting device.

2. The bed according to claim 1, wherein each cross bracing comprises a cross brace and two angular or arcuate braces which extend from the cross brace to the upper ends of the legs, and, at the angular or arcuate braces, the legs are guided and supported at the guiding profiles.

3. The bed according to claim 2, wherein the legs are articulated to support braces which are supported at the frame in a manner rotatable about axes extending in parallel to the frame transverse parts.

4. The bed according to claim 1, wherein the legs are articulated to support braces which are supported at the frame in a manner rotatable about axes extending in parallel to the frame transverse parts.

* * * * *